United States Patent [19]

Albrecht

[11] 3,939,782

[45] Feb. 24, 1976

[54] FLUIDIZED FURNACE CONSTRUCTION FOR BURNING PARTLY DEHYDRATED SLUDGE

[75] Inventor: Erhard Albrecht, Essen, Germany

[73] Assignee: Rheinstahl Aktiengesellschaft, Essen, Germany

[22] Filed: Nov. 1, 1974

[21] Appl. No.: 520,207

[30] Foreign Application Priority Data

Nov. 9, 1973 Germany ..... 2356060

[52] U.S. Cl. ..... 110/8 F; 34/57 C; 110/28 F

[51] Int. Cl.[2] ..... F23G 5/12; F26B 17/00

[58] Field of Search ..... 110/8 F, 28 J; 34/57 C; 432/58

[56] References Cited

UNITED STATES PATENTS

| | | | |
|---|---|---|---|
| 3,394,463 | 7/1968 | Futer | 34/57 C |
| 3,397,657 | 8/1968 | Tada | 110/28 X |
| 3,484,948 | 12/1969 | Whelan | 34/57 C |
| 3,702,595 | 11/1972 | Muirhead et al. | 110/28 |

FOREIGN PATENTS OR APPLICATIONS

| | | | |
|---|---|---|---|
| 429 | 6/1913 | United Kingdom | 34/57 C |

*Primary Examiner*—Kenneth W. Sprague
*Attorney, Agent, or Firm*—McGlew and Tuttle

[57] ABSTRACT

A fluidized bed-furnace for burning partly dehydrated sludge comprises a furnace housing having a bottom forming a surface for a fluidized bed. Side walls extend upwardly from the bottom and above the fluidized bed in defining combustion chamber above the bed. An inlet for sludge on one side of the housing extends into the side walls and a discharge for the sludge on the opposite side of the housing extends outwardly from the side walls. The bottom is made of a plurality of steps arranged at distinct elevations in descending order from the inlet to the outlet or discharge. Each step portion includes a grate having a wind box associated therewith through which heating gases and including combustion air is directed upwardly through nozzle elements which extend in openings of the grate. The entire bottom with all of the step portions are advantageously supported on a support structure which is suspended at the bottom of the furnace and it is advantageously removable from the bottom.

12 Claims, 2 Drawing Figures

FLUIDIZED FURNACE CONSTRUCTION FOR BURNING PARTLY DEHYDRATED SLUDGE

The present invention is particularly directed to a furnace of a type which includes a fluidized bed for burning partly dehydrated sludge. The fluidized bed includes a fill of refractory grains to be fluidized by means of air supplied through bottom nozzles and which combines with the gases formed by the sludge in the combustion process. Many types of devices for carrying out such an operation are known. For example, in the periodical "Chemie-Ingenieur-Technik" 1969, pages 615–619, there is disclosed a system in which the sludge to be burned is fed to a fluidized bed where it is dried, pulverized, degasified and ignited. The residual fine, solid particles pass into the upper layers of the fluidized bed and are finally evacuated as a flue dust. The original material constituting the fluidized bed and comprising, for example, sand with grain sizes of from 1 to 2 mm is also gradually disintegrated due to the high stresses and it is evacuated along with the ashes. This loss is replaced by coarser ash particles and primarily by sand grains contained in the sludge which is fed into the combustion chamber as well as by adding fresh sand. However, depending on the nature of the sludge, bed material enriched with ashes is to be discharged from the fluidized bed from time to time. This particularly applies to the so-called rack sludges wherein after the combustion of the sludge particles are left which are so coarse that they cannot be evacuated as flue dust and they are unsuitable for being used for the maintaining the fluidized bed. Such coarse particles may be discharged through a discharge opening along with some still usable sand which must then be replaced. In this case, however, the usual discharge openings are to be correspondingly enlarged. The compensation of the bed material thus lost becomes increasingly expensive with the increasing quantities of coarse particles in the sludge.

SUMMARY OF THE INVENTION

The present invention is directed to a fluidized bed furnace which is constructed so that as little as possible of the useful bed material is lost during the discharge of coarse particles. In addition, the construction is such that coarse particles will not be discharged prior to being sufficiently treated in the fluidized bed. Also, the discharge of the coarse particles is effected by a construction which is simple in design and great importance is attached to the possibility of re-establishing the operational capacity as soon as possible in case of disturbances. This importance is due to the fact that the storage property and possibility of sludges to be burned is limited while, at the same time, they are produced continually as municipal or industrial sewage sludges. Therefore, as far as possible, the continous operation must not be interrupted.

In accordance with the invention, there is provided a furnace bottom construction which has a plurality of step portions at different levels and which levels vary in a descending order from the inlet toward the discharge opening of the furnace. In a particularly advantageous embodiment of the invention, the bottom is subdivided into individual steps which extend at different levels and transversely to the connection line between the discharge opening and the side remote therefrom. Coarser particles which cannot be so easily fluidized as the fill of refractory grains provided for the fluidized bed are thus accumulated near the discharge opening. This happens also in cases where the coarse particles are relatively light in themselves. The time necessary for the accumulation of the coarse particles near the discharge opening can be influenced by appropriately dimensioning the level of differences of the individual step portions as well as by the correspondingly sloping the step surfaces. A particularly advantageous treatment of the coarse sludge particles and a minimized loss by discharge of the useful bed material is obtained by providing a level difference between the adjacent steps of approximately 20 mm. An additional advantage is to provide an inclination of the steps up to 3°.

In order to insure a sludge treatment which is as extensive as possible, particularly with sludges containing coarse particles to be discharged, it is useful to provide a furnace feed opening near the portions of the bottom extending at the highest level. In such a construction, the sludge to be treated passes through the fluidized bed which, in itself, is intended for vertical operation substantially in the horizontal direction until the residual coarse particles are accumulated near the discharge opening. For this kind of treatment in the horizontal direction, the fluidized bed has proved surprisingly suitable.

Accordingly, it is an object of the invention to provide an improved fluidized bed furnace for burning particularly partly dehydrated sludge which includes a bottom for supporting the fluidized bed which is made up of a plurality of step portions arranged at heights in descending order from an inlet side of the furnace to a discharge side of the furnace.

A further object of the invention is to provide a fluidized bed furnace construction which is simple in design, rugged in construction and economical to manufacture.

The embodiment of the invention in which an exclusive property or privilege is claimed is defined as follows:

GENERAL DESCRIPTION OF THE PREFERRED EMBODIMENT

Figure 1:
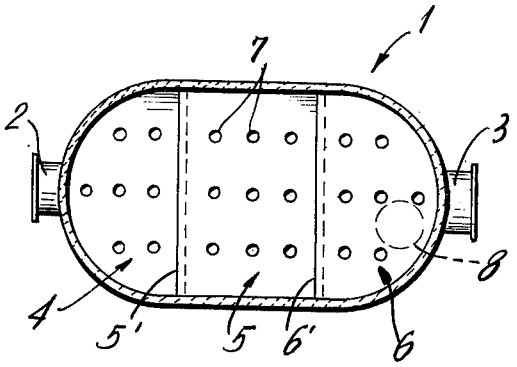
FIG. 1 is a top plan view of a fluidized bed furnace with the top wall or roof removed and constructed in accordance with the invention.
Figure 2:
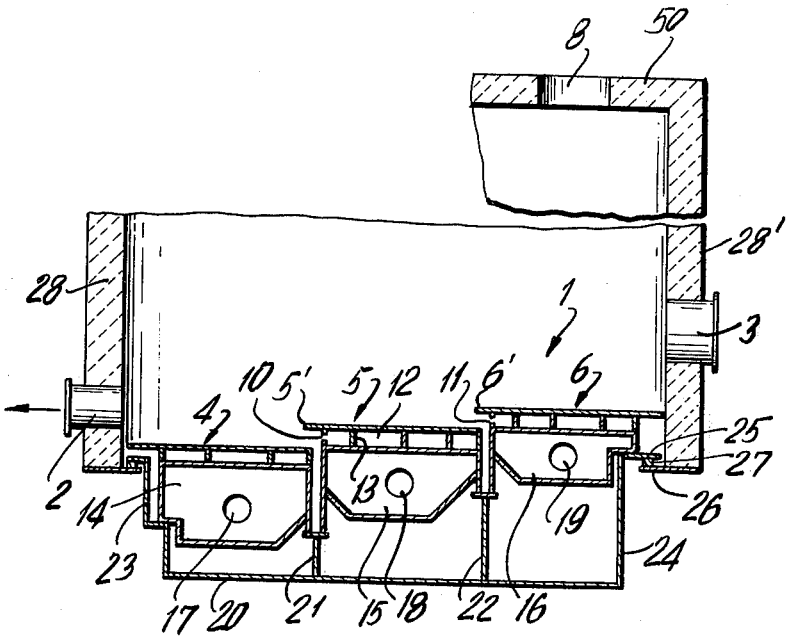
FIG. 2 is a longitudional sectional view of the furnace shown in FIG. 1.

Referring to the drawings, in particular, the invention embodied therein comprises a fluidized bed furnace having a bottom generally designated 1 which supports a fluidized bed. Side walls 28, 28' rise upwardly from each side of the bottom 1 and the bottom slopes downwardly from an inlet 3 for the sludge on one side wall to an opposite side with a discharge 2 extending outwardly from the opposite side wall 28.

In accordance with the invention, the bottom one is made up of a plurality of step portions generally designated 4, 5, and 6 respectively disposed between the inlet 3 and the outlet 2 at distinct levels which are in descending order from the inlet to the outlet. In the preferred arrangement, the step portions 6 and 5 at the higher level project over the next lower step 5 and 4 of the next adjacent lower level. These projections form ovalized or step edges 5' and 6' which project in a direction of the discharge opening 2 by approximately 2 cm over the respective lower steps 5 and 4.

Means are provided for supplying air upwardly through each of the step portions 4, 5, and 6 and these advantageously comprise nozzles 7 which extend through openings in the individual steps and are supplied with heated gases which include combustion air from individual wind boxes 14, 15 and 16, respectively.

The sludge to be treated is fed in through the inlet 3 or through an opening 8 in a top wall or roof 50 which is above the fluidized bed. However, particularly with rack sludges wherein the sludge can be fed laterally, it is fed through a flange connection line of the opening 3.

In the preferred arrangement, free blow openings 10 and 11 are defined between adjacent step sections and air is continuously blown out of these openings to prevent the bed material from passing into the interspace between the step portions 4, 5 and 6.

The bottom parts forming the step portions 4, 5 and 6 are advantageously made of a steel sheet material reinforced by intersecting ribs such as ribs 12 and 13. Each wind box is provided with a connection inlet for blowing in hot air at locations 17 and 18 and 19, respectively. Individual wind boxes can be controlled independently, and this is advantageous in view of the different heights of the bed layers above the individual steps and it also permits an adapatation to the condition of the sludge in respect to its preparation and combustibility. In addition, the step portions and their associated wind boxes 14, 15 and 16 are accommodated in a floor frame 20 which is provided with supporting wall portions 21 and and 22 upon which the wind boxes 14, 15 and 16 rest. The boxes also rest on angles 23 and 24 which are provided at the periphery of the floor frame. The angles 23 and 24 also project from the floor frame outwardly and rest with their flange portions 25 on an annular member 26 which is secured to the bottom of the furnace body or housing. Advantageously, the supporting surface is provided with a seal 27. With such a design, the furnace housing is also advantageously suspended above its bottom from carrier supports. Thus, all of the parts of the bottom are accessible from below and this is very useful for maintenance and control.

The discharge opening 2 provided in the wall 28 is advantageously designed as a flange discharge connection. Through this opening, the coarse parts or the ashes which have not been pulverized to flue dust may be discharged without losing the still usable bed material.

The steps in their wind boxes may also be received in a carrier frame which is secured to the lower edge of the furnace and can be lowered so that the individual steps and their wind boxes can be dismounted and replaced.

A further advantage is obtained by designing the bottom with steps extending at different levels so that a vertical circulation of the material of the fluidized bed and the sludge is produced so that the preparation and combustion conditions are improved. Finally, it is advantageous, due to the division of the bottom into individual steps, the natural oscillation frequencies of the bottom are increased and primarily differentiated so that during the operation, disturbances which could otherwise occur through resonance oscillations of a closed bottom are avoided. For this purpose, the natural oscillation frequencies of the individual steps differ from each other so that the steps can never be set in vibration together.

While a specific embodiment of the invention has been shown and described in detail to illustrate the application of the principles of the invention, it will be understood that the invention may be embodied otherwise without departing from such principles.

What is claimed is:

1. A fluidized bed furnace for burning partly dehydrated sludge, comprising a furnace housing having a bottom forming a fluidized bed support, side walls extending upwardly from said bottom and above the fluidized bed and defining a combustion chamber above the fluidized bed, an inlet for sludge on one side of said housing extending through said side walls, a discharge for the sludge on the opposite side of said housing extending outwardly through said side walls, said bottom comprising a plurality of step portions arranged at distinct elevations in descending order from said inlet to said discharge, and means for directing air upwardly through said step portions for maintaining a vertical operation of said bed and for supporting combustion in said combustion chamber.

2. A fluidized bed furnace according to claim 1, wherein said step portions of said bottom extend at different levels transversely to the path between said inlet at one side of said furnace to said discharge on the opposite side.

3. A fluidized bed according to claim 1, wherein said step portions include surfaces which are inclined downwardly in a direction toward said discharge opening.

4. A fluidized bed furnace according to claim 1, wherein said step portions and higher elevations project over the next adjacent lower step portions.

5. A fluidized bed furnace according to claim 1, wherein each step portion is vertically spaced from the next adjacent step portion by about 20 mm.

6. A fluidized bed furnace, according to claim 1, wherein each of the step portions includes surfaces which have an inclination up to 3°.

7. A fluidized bed furnace according to claim 1, including an opening for the sludge extending downwardly from the top of the furnace into the combustion chamber.

8. A fluidized bed furnace according to claim 1, wherein said inlet is located adjacent the bottom of said furnace on one of said side walls.

9. A fluidized bed furnace according to claim 1, including free flow opening between each step portion for blowing the fluidized bed away from the joint between said portions.

10. A fluidized bed furnace according to claim 1, wherein said step portions each include sheet steel platforms reinforced by inner ribs and including a separate wind box connected to each platform beneath each of said platforms.

11. A fluidized bed furnace according to claim 1, including a floor frame, said bottom step portions being carried by said floor frame, said furnace having an annular flange supporting said floor frame.

12. A fluidized bed according to claim 1, wherein said step portions include parts which have different natural oscillation frequencies.

* * * * *